US008298373B2

(12) United States Patent
Ni et al.

(10) Patent No.: US 8,298,373 B2
(45) Date of Patent: Oct. 30, 2012

(54) COMBINED PROCESS OF PEROXIDE BLEACHING OF WOOD PULPS AND ADDITION OF OPTICAL BRIGHTENING AGENTS

(75) Inventors: Yonghao Ni, Fredericton (CA); Zhibin He, Fredericton (CA)

(73) Assignee: University of New Brunswick, Fredericton (CA)

( * ) Notice: Subject to any disclaimer, the term of this patent is extended or adjusted under 35 U.S.C. 154(b) by 402 days.

(21) Appl. No.: 12/320,944

(22) Filed: Feb. 9, 2009

(65) Prior Publication Data

US 2009/0205795 A1 Aug. 20, 2009

Related U.S. Application Data

(60) Provisional application No. 61/006,945, filed on Feb. 7, 2008.

(51) Int. Cl.
*D21C 3/00* (2006.01)

(52) U.S. Cl. ..... 162/78; 162/100

(58) Field of Classification Search ..... 162/78, 162/100

See application file for complete search history.

(56) References Cited

U.S. PATENT DOCUMENTS

| | | | | |
|---|---|---|---|---|
| 4,804,440 | A * | 2/1989 | Liebergott et al. | 162/70 |
| 5,902,454 | A | 5/1999 | Nelson | |
| 2006/0144534 | A1* | 7/2006 | Paren et al. | 162/76 |
| 2007/0277947 | A1* | 12/2007 | Nguyen | 162/71 |
| 2008/0017337 | A1* | 1/2008 | Duggirala et al. | 162/70 |
| 2008/0066878 | A1 | 3/2008 | Nguyen | |

FOREIGN PATENT DOCUMENTS

| | | |
|---|---|---|
| CA | 686115 | 5/1964 |
| CA | 820190 | 8/1969 |
| CA | 1274655 | 10/1990 |
| CA | 1310797 | 12/1992 |
| CA | 2070556 | 12/1992 |
| CA | 20471388 | 9/1999 |

(Continued)

OTHER PUBLICATIONS

Bourgoing et al., Use of Flourescent Whitening Agents Against Light-Induced Colour Reversion of High Yield Pulps, ISWPC, vol. 2, 10-1 to 10-4, 1997.

(Continued)

*Primary Examiner* — Matthew Daniels
*Assistant Examiner* — Jacob Thomas Minskey
(74) *Attorney, Agent, or Firm* — Hill & Schumacher

(57) ABSTRACT

A process for improving optical properties of high-yield pulp (HYP) for producing paper products with superior brightness. Optical brightening agents (OBAs) can effectively improve the optical properties of high-yield pulp (HYP). The present process involves incorporating the OBAs into the alkaline peroxide bleaching process. By combining peroxide bleaching with an optical brightening agent, one can decrease the bleaching cost to reach the same brightness target. Some key advantages of adding OBA to HYP at the pulp mill over the conventional wet-end addition of OBA include: i) the quenching effect on OBA by the wet-end cationic polymers such as PEI is decreased by fixing OBA on HYP fibers; ii) the negative impact of metal ions in the white water system on the OBA performance is minimized when OBA is pre-adsorbed and fixed on HYP fibers; iii) the photo-yellowing (color reversion) of HYP and HYP-containing paper sheets is decreased when more OBA is on HYP fibers to protect them from harmful UV radiation.

16 Claims, 8 Drawing Sheets

FOREIGN PATENT DOCUMENTS

EP 0 899 373 A1 3/1999

OTHER PUBLICATIONS

Bourgoing et al., Use of Flourescent Whiteniong Agents to Inhibit Light-Induced Colour Reversion of Unbleached Mechanical Pulps, JPPS, vol. 27, No. 7 240-244, Jul. 2001.
Crouse et al, Flourescent Whitening Agents in the Paper Industry, TAPPI, vol. 64, No. 7, Jul. 1981, pp. 87-89.
Unknown, Diffuse Brightness of Pulp (S/0), T 525 om-92, TAPPI, 5 pages, 1992.
Zhang et al., Using Optical Brightening Agents (OBA) for Improving the Optical Properties of Hyup-Containing Paper Sheets, 94th Annual Meeting Pulp and Paper Technical Association of Canada, pp. B561-B570.
Zhang et al., Retention of Optical Brightening Agents (OBA) and Their Brightening Efficiency on HYP-Containing Paper Sheets, Journal of Wood Chemistry and Technology, 27, 153-167, 2007.
Unknown, Forming Handsheets for Reflectance Testing of Pulp (Sheet Machine Procedure), T 272 om-92, TAPPI, 1992HE.
Scheringer et al., Comparing the Environmental Performance of Flourescent Whitening Agents with Peroxide Bleaching of Mechanical Pulp, Journal of Industrial Ecology, vol. 1, No. 4, pp. 77-95, 2000.
Zhjang et al., Effectiveness of Optical Brightening Agent (OBA) on High Yield Pulps (HYPS), PAPTAC, 93 Annual Meeting, 2007, PAES B235-B239.
Bourgoing et al., Inhibition of Light Induced Colour Reversion by Diaminostilbene Derivatives Flourescent Whitening Agents—Molecular Simulation Correlation, 87th Annual Meeting of PAPTAC, pp. B47-B54.
Ragauskas et al., Brightness Reversions of Mechanical Pulps XIV: Application of FWAs for High-Brightness, High-Yield Pulps, Solutions Nov. 2001, One Page.
Guillichsen et al., Papermaking Science and Technology, Chapter Forward, Papermaking Chemistry, pp. 115.
Ford et al, HYH Spells a Good Deal for the Future, Pulping and Bleaching, Oct. 1996, pp. 29-39.
Levlin, On the Use of Chemi-Mechanical Pulps in Fine Papers, Paper and Timber 72(1990): 4, pp. 301-308.
Reis, The Increased Use of Hardwood High Yield Pulps for Functional Advantages in Papermaking, TAPPI Press pp. 87-108, 2001.
Cannell et al, The Future of BCTMP, Pulp and Paper, May 2000, 61-76.
Zhou, Overview of High Yield Pulps (HYP) in Paper and Board, PAPTAC 90th Annual Meeting, 2004, pp. B-1429-B-1434.

* cited by examiner

COMBINED PROCESS OF PEROXIDE BLEACHING OF WOOD PULPS AND ADDITION OF OPTICAL BRIGHTENING AGENTS

CROSS REFERENCE TO RELATED U.S. PATENT APPLICATION

This patent application relates to U.S. utility patent application Ser. No. 61/006,945 filed on Feb. 7, 2008 entitled COMBINED PROCESS OF PEROXIDE BLEACHING OF WOOD PULPS AND ADDITION OF OPTICAL BRIGHTENING AGENTS, filed in English, which is incorporated herein in its entirety by reference.

FIELD OF THE INVENTION

The present invention relates to a combined hydrogen peroxide bleaching process in which optical brightening agents are incorporated into the pulp to give an improved hydrogen peroxide bleaching process for mechanical or high-yield pulps for producing a very high brightness pulp economically.

BACKGROUND OF THE INVENTION

There is a need to provide various paper grades, including printing and writing quality papers, to be produced with greater brightness. This requires that the pulp furnish, which is needed to manufacture the paper products, have very high brightness.

The bleached chemi-thermo-mechanical pulp (BCTMP), also known as high-yield pulp (HYP) has many unique properties such as high bulk and light scattering coefficient that are desirable for printing and writing paper products [1-5]. However, based on currently available bleaching technologies, the economical brightness levels of HYP are still significantly lower and its yellowness (b*) higher than those of fully bleached kraft pulps (BKP) [1-2]. For example, Aspen HYP can be bleached to about 85% ISO brightness from the alkaline peroxide bleaching process, however, the production cost increases exponentially when a very high brightness (e.g. higher than 80% ISO) is required. Also, in some commercial applications extremely high brightness (higher than 88% ISO) is required, and the conventional peroxide bleaching in these cases would become prohibitively expensive.

Optical brightening agents (OBAs) or fluorescent whitening agents (FWAs) are commonly used to improve the optical properties of printing and writing paper during the papermaking process [6]. Both the paper brightness and whiteness can be increased with the addition of OBA. Also, OBA can decrease the photo-yellowing (photo-reversion) of HYP by acting as an UV screen [7, 8, 9]. It has also been reported that the overall environmental impact of using OBA might be better than peroxide for a certain level of brightness gain of mechanical pulps [9].

Conventionally, OBA is applied to pulp at the wet-end of the papermaking process. OBA molecules adsorb on pulp fibers by forming hydrogen bonding with cellulose in fibers. When OBA is added to a mixed furnish, HYP will compete with BKP for OBA. Ideally, OBA adsorbed on HYP fibers would be more effective in whitening HYP-containing paper sheets. To have more OBA on HYP fibers rather than on BKP fibers, OBA may be added to HYP at the pulp mill during the HYP production process. Another factor affecting OBA efficiency is its retention on fibers. It has been reported that OBA retention decreased with the increase of HYP substitution rate due to the lower affinity of OBA molecules to HYP fibers [10, 11]. As a result, the OBA efficiency decreased. Although the white water circulation system can improve the overall retention of OBA, the un-absorbed OBA molecules in the white water can undergoes a transformation from trans- to cis-configuration and loses its fluorescent properties [6].

U.S. Pat. No. 5,902,454 and European patent application Serial No. EP 0899 373 A1 disclose the use of OBA to increase the brightness of HYP.

Typical state of the art processes for peroxide bleaching of HYP are described in the following references. First Presley, J. R. and Hill, R. T., Pulp Bleaching: Principles and Practice, Edited by C. W. Dence and D. W. Reeve, Page 480 discloses the so-called cascade system for preparation of bleach liquor, in which magnesium sulfate and sodium silicate are added to water and intimately mixed, followed by the addition of caustic soda and finally by the addition of hydrogen peroxide. The resulting liquor is subsequently mixed with pulp.

Presley, J. R. and Hill, R. T., Pulp Bleaching: Principles and Practice, Edited by C. W. Dence and D. W. Reeve, Page 481 discloses the so-called in-line system, where similar mixing and addition occurs but without the cascade arrangement.

Ni, Y. et al., Pulp and Paper Canada, 104(12):78 (2003) discloses a sequential addition of chemicals beginning with the addition of silicate or DTPA, or other peroxide stabilizers to a pulp slurry and the subsequent addition of hydrogen peroxide. Alkali sources, such as sodium hydroxide can be added simultaneously with the stabilizers. The following patents deal with bleaching processes for mechanical or high-yield pulp, but do not address the process of the present invention: Canadian Patent Nos. 686, 115; 820,190; 1,294, 655; 1,310,797; 2,041,588; 2,070556.

Therefore, there is a need to increase the brightness in a more cost-effective manner. Also, there is a need to produce HYP pulps with extremely high brightness in a more economic way.

SUMMARY OF THE INVENTION

The present invention provides embodiments of processes of peroxide bleaching of wood pulps during which optical brightening agents are incorporated into the wood pulp. It has now been determined that improvement in the bleaching process can be obtained if OBA is added to the pulp during the peroxide bleaching process.

Thus in an embodiment of the present invention there is provided a process for bleaching wood pulp, comprising the steps of:

a) mixing a wood pulp slurry containing a chelating agent to form a first mixture, and washing and pressing said first mixture to produce a transition metal-depleted pulp slurry and a first discharge effluent; and b) alkaline peroxide bleaching the transition metal-depleted pulp slurry by mixing the transition metal-depleted pulp slurry with an optical brightening agent (OBA) and an alkaline peroxide bleaching liquor including at least $H_2O_2$ to form a second mixture and bleaching said second mixture to form a bleached pulp.

A further understanding of the functional and advantageous aspects of the invention can be realized by reference to the following detailed descriptions and drawings.

BRIEF DESCRIPTION OF THE DRAWINGS

The invention will be more fully understood from the following detailed descriptions thereof taken in connection with the accompanying drawings, which form a part of this application, and in which.

DETAILED DESCRIPTION OF THE INVENTION

Generally speaking, the systems described herein are directed to hydrogen peroxide bleaching processes for mechanical or high-yield pulps for producing a very high brightness pulp economically. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to hydrogen peroxide bleaching processes for mechanical or high-yield pulps for producing a very high brightness pulp economically.

As used herein, the term "about", when used in conjunction with ranges of dimensions of particles or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present invention.

Figure 1:
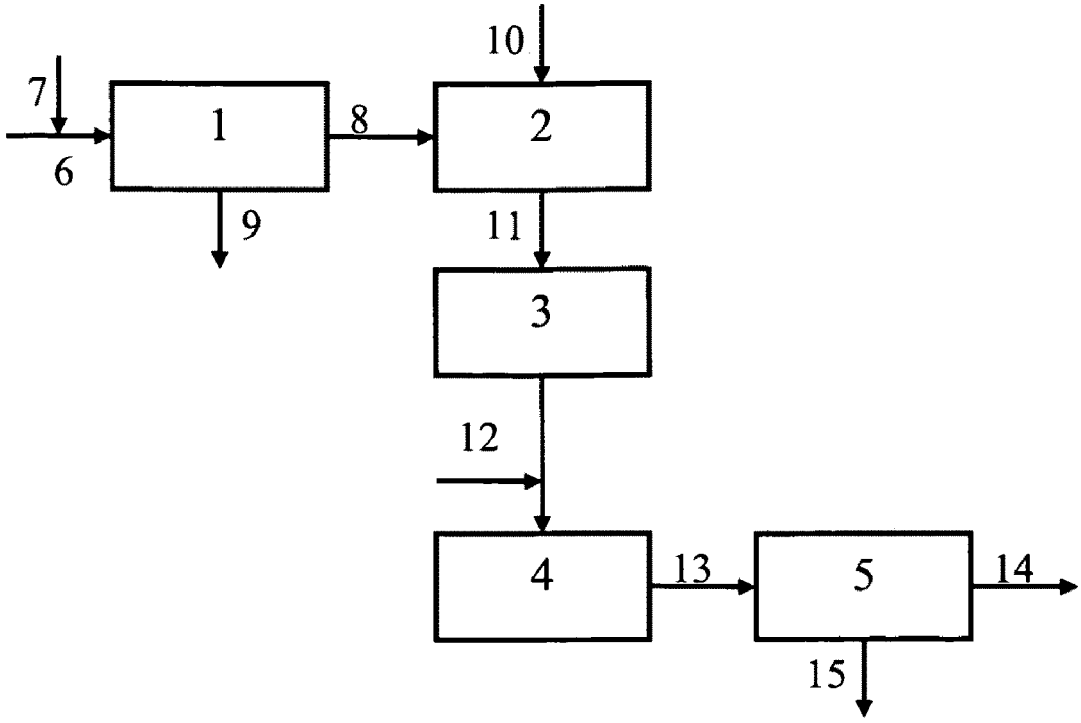
FIG. 1 is a block diagram illustrating the high-consistency process in accordance with the present invention.

FIG. 1 illustrates a basic procedure for a one-stage high-consistency bleaching process of the present invention. A pulp slurry (6) is added with a chelating agent diethylene tri-amine penta-acetic acid or its salt (DTPA) or ethylene di-amine tetra-acetic acid or its salt (EDTA) (7) and fed into a press/washer (1). The press has discharge effluent (9) and transition metal-depleted pulp slurry (8). As used herein, the phrase "high consistency bleaching process" means a process in which the transition metal-depleted pulp slurry has a consistency higher than 15%. A bleaching liquor (10), containing water, an alkali source, (such as, but not limited to NaOH, $Mg(OH)_2$, MgO, $MgCO_3$, $Na_2CO_3$) $H_2O_2$, silicate (other $H_2O_2$ stabilizers, such as DTPA, EDTA, $MgSO_4$ may be added here too), is added to the pulp slurry via mixer (2) along with the optical brightening agents (OBA), which then discharges the mixture (11) to a bleach tower (3). After the required reaction time, the bleached pulp is discharged from the tower and water (12) is added subsequently via pump (4) and the bleached pulp slurry (13) is pumped to a press/washer (5). The effluent discharge (15) may be added to up streams to reuse the residual peroxide, and the bleached pulp (14) will be sent to the subsequent unit operation.

Figure 2:
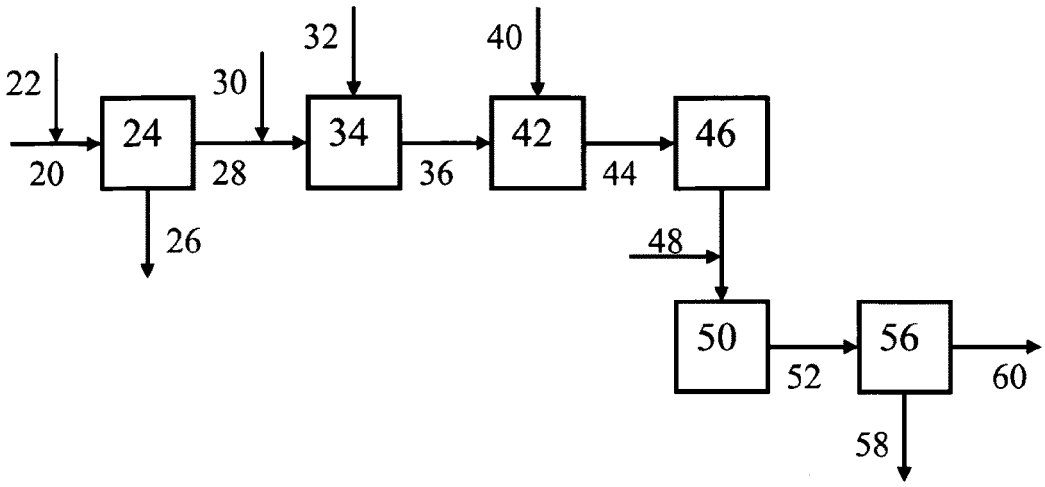
FIG. 2 is a block diagram showing a medium-consistency process in accordance with the present invention.

FIG. 2 illustrates a basic procedure for the medium-consistency bleaching process of the present invention. A pulp slurry (20) is added with chelating agent (DTPA or EDTA) (22), and fed into a press/washer (24). The press has discharge effluent (26) and transition metal-depleted pulp slurry (28), to which process water (30) is added, subsequently, chemicals (32), which include OBA, NaOH, silicate (other $H_2O_2$ stabilizers, such as DTPA, EDTA, $MgSO_4$ may be added) are added to the pulp slurry via pump (34) to produce a mixture (36), and then $H_2O_2$ (40) is added to the mixture via mixer (42). As used herein, the phrase "medium consistency bleaching process" means a process in which the transition metal-depleted pulp slurry has a consistency of 5-15%.

The discharge (44) from the mixer (42) will be fed to a bleach tower (46). After the required reaction time, the bleached pulp is discharged from the tower (46) and $SO_2$ (48) may be used if the mill is practicing acidification) and is diluted via pump (50), pulp slurry (52) is fed into press/washer (56). The effluent discharge (58) may be added to up streams to reuse the residual $H_2O_2$ if the mill practices reuse of the residual $H_2O_2$; the bleached pulp (60) will be sent to the subsequent unit operation. More than one peroxide bleaching stage may be practiced.

The basic differences in the methods described above with respect to FIGS. 1 and 2 is that in the high consistency process of FIG. 1, the transition metal-depleted pulp slurry is mixed with the OBA and with bleaching liquor 10 which includes water, the $H_2O_2$, alkali source, and $H_2O_2$ stabilizers. In the medium consistency process of FIG. 2, the metal-depleted pulp slurry is mixed with water, then mixed with OBA and this mixture is mixed with the alkali source and $H_2O_2$. Thus making up the bleaching liquor. The end result in both cases results in the metal-depleted pulp slurry mixed with OBA and bleaching liquor.

The optical brightening agents may include, but are not restricted to, di-sulfonic types, hexa-sulfonic and tetra-sulfonic types of OBA.

Thus, the invention provides a process for peroxide bleaching of mechanical or high-yield pulp, which is comprised of adding to a pulp slurry, an OBA and the required bleach liquor containing NaOH, $H_2O_2$, silicate (other $H_2O_2$ stabilizers, such as DTPA, EDTA, $MgSO_4$, may be added), and subjecting the pulp slurry to pre-selected conditions to complete the bleaching process.

In a further embodiment, the process comprises adding to a pulp slurry at least one stabilizer for stabilizing transition metal ions, adding NaOH to the pulp slurry simultaneously with or subsequent to the addition of the stabilizer, subsequently adding hydrogen peroxide to the pulp slurry at a pre-selected point, and subjecting the pulp slurry to pre-selected conditions to complete the bleaching process. OBA can be added to the slurry with the stabilizer. The stabilizer may be, but is not limited to silicate, DTPA, EDTA, or other sequestering agents.

According to an aspect of the present invention OBA can be added to a peroxide bleaching process which is comprised of more than one peroxide bleaching stage. In such embodiments, OBA can be added to all peroxide stages, or it can be added only on the last peroxide bleaching stage.

The present invention will now be illustrated with the following non-limiting examples.

EXAMPLE 1

Equivalent to 25 grams of o.d. mill chelated TMP pulp from a mill in Eastern Canada (66 ppm Mn, 56% ISO initial brightness) was mixed in a polyethylene bag with 2.8% NaOH, 3.5% silicate, 6.0% $H_2O_2$, 0.4% OBA (Tinopal UP from CIBA Chemicals). The bag, along with its contents was placed in a temperature bath at 70°. Other bleaching conditions were 3 hrs, 30% pulp consistency.

After the completion of the required reaction time, a portion of the pulp slurry was transferred from the bag to a beaker, diluted, and neutralized with sulfurous acid to pH 5. A handsheet was then made following TAPPI test method T272 [12], air-dried and determined for brightness according the TAPPI method T525 [13]. The brightness of the resulting pulp was 82.8% ISO.

Under otherwise the same procedure and conditions as above, however no OBA was added, the brightness was 80.7% ISO. Therefore, it can be concluded that the addition of 0.4% OBA in the bleaching process significantly improves the pulp brightness.

EXAMPLE 2

The same pulp sample was used as in Example 1, and the same procedure followed, however, various amounts of OBA charges were used. The results are shown in Table 1.

TABLE 1

| OBA charge (%) | Brightness with OBA added (% ISO) | Brightness without OBA (% ISO) |
|---|---|---|
| 0.2 | 81.7 | 80.7 |
| 0.8 | 84.2 | 80.7 |

These results support the conclusion that the OBA addition to the peroxide bleaching process can effectively increase the pulp brightness.

EXAMPLE 3

Equivalent to 10 grams o.d. mill chelated aspen CTMP (HYP) from a mill in Western Canada was mixed in a polyethylene bag with 4.0% NaOH, 2.6% silicate, 0.05% Epsom salt ($MgSO_4.7H_2O$), 6.2% $H_2O_2$, various amounts of OBA (Tinopal UP from CIBA Chemicals). The bag, along with its contents, was placed in a temperature bath at 80° C. The other bleaching conditions were 2 hrs, 17% pulp consistency.

After the completion of the required reaction time, a portion of the pulp slurry was transferred from the bag to a beaker, diluted, and neutralized with sulfurous acid to pH 5. A handsheet was then made following TAPPI test method T272 [12], air-dried and determined for brightness. The same pulp sample was subjected to the peroxide bleaching without the addition of OBA under otherwise the same conditions. The results are given in Table 2.

TABLE 2

| OBA charge (%) | Brightness with OBA added to peroxide stage (% ISO) | Brightness without OBA (% ISO) | Brightness with OBA added after peroxide bleaching (% ISO) |
|---|---|---|---|
| 0.2 | 90.1 | 86.4 | 89.0 |
| 0.4 | 91.7 | 86.4 | 90.3 |
| 0.8 | 92.4 | 86.4 | 91.5 |

Another set of experiments was performed. Under a constant mixing, various amounts of OBA were added to a pulp slurry at 1% consistency (the pulp was bleached under the conditions of 4% NaOH, 2.6% silicate, 0.05% Epsom salt, 6.2% $H_2O_2$, 17% pulp consistency, 80° C., 2 hrs, and its brightness was 86.4%). After 5 min, a handsheet was then made following TAPPI test method T272 [12], air-dried and determined for brightness. The above procedure is similar to that outlined in European Patent application, EP 0899 373 A1. The results are shown in Table 2 as brightness with OBA added after peroxide bleaching. One can find that our present process is much more efficient in improving pulp brightness, i.e. at the same OBA dosage, one can obtain a higher brightness.

EXAMPLE 4

A softwood bleached kraft pulp (SW BKP), a hardwood (eucalyptus) bleached kraft pulp (HW BKP) and commercial aspen high yield pulps (HYPs) were obtained from Tembec Inc. The kraft pulps were refined in a PFI to about 450 and 500 ml CSF freeness, respectively, and the high yield pulps were used as received. Optical brightening agents were obtained from Ciba. The charge of OBA in this study was based on the liquid products.

The photo-reversion of handsheets was performed in a photoreactor, with a total intensity of either 9-10 $mW/cm^2$ (approximately 53 times greater than the intensity of normal office light) fluorescent light or 2.7 $mW/cm^2$ UV light (with a nominal wavelength of 350 nm). A fan is installed in the back of the photoreactor for temperature control.

Incorporating OBA Brightening into the Alkaline Peroxide Bleaching Process in HYP Production Conventionally, OBA is used at the wet-end of the papermaking process. When HYP is substituted for HW BKP in printing and writing paper to take advantages of its high bulk and light scattering, the brightness and whiteness are affected negatively due to the inferior brightness and whiteness of HYP. However, the negative effect of HYP on brightness and whiteness can be compensated for by adding more OBA at the wet-end [14].

Figure 3:
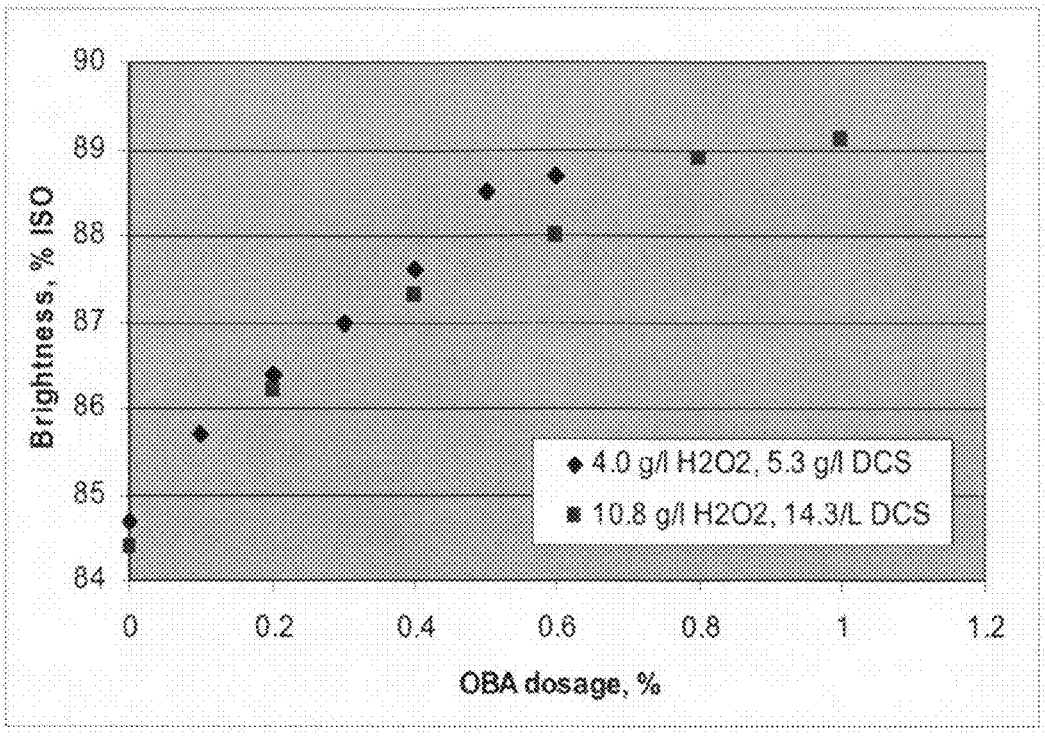
FIG. 3 shows the effect of peroxide concentration and dissolved and colloidal substances (DCS) on the brightening performance of OBA (Tetra-sulfonic OBA)

The present inventors have discovered that by adding the optical brightening agents to HYP at the pulp mill, the higher temperature and longer contact time can improve OBA retention and thus its brightening efficiency. If OBA experiences no interference with the alkaline peroxide bleaching, and the alkaline peroxide has no effect on the fluorescent properties of the OBA, the application of OBA can be conveniently incorporated into the bleaching process. Based on experimental disclosed herein, the inventors have confirmed that there is no reaction between OBA and the peroxide-containing bleach liquor under the normal bleaching conditions. FIG. 3 also shows that different levels of peroxide concentration and DCS have negligible effect on the brightening efficiency of OBA. In the mill operation, OBA can be added to the pulp along with the bleach liquor, as shown in FIG. 1 and FIG. 2.

To bleach HYP to high brightness (e.g. 85% ISO), stronger bleaching conditions (higher peroxide charge, alkalinity and temperature) are usually needed, which can decrease the bulk and light scattering coefficient of HYP. If the brightness target of HYP is lowered from 85% ISO to 83% ISO in peroxide bleaching, the production cost of HYP will decrease significantly, while the bulk and light scattering of HYP can be preserved. The concept can decrease the production cost. For example, for peroxide bleaching to increase 83% ISO to 85% ISO, an additional 2% peroxide is required; for using OBA to achieve the same brightness gain, about 0.2% Tinopal UP is needed. The cost for the OBA and hydrogen peroxide is about $2000/t and $800/t respectively, thus the economic benefit of using OBA is rather evident.

Adding OBA to Pulp Furnish Containing OBA-Treated HYP

For high brightness printing and writing paper grades (>88% ISO), OBA is normally added at the wet-end of the papermaking process. When the OBA-treated HYP is partly substituted for hardwood BKP, a question arises as to whether the brightening efficiency of OBA added at the wet-end will be affected negatively.

The inventors designed a set of experimental trials, whereby, the hardwood BKP was partially substituted with the OBA-treated HYP (Grade 325/90); OBA was then added to the mixed furnish at 1% pulp consistency, 100 ppm calcium concentration, pH 6.5. Theses conditions were similar to the wet-end addition of OBA in the papermaking process. Handsheets were then made to determine the brightness. Results in Table 2 shows that for a brightness level up to 92% ISO, the presence of the OBA-treated HYP has negligible effect on the final brightness for the HYP substitution of 15% or lower. However, at a brightness higher than 92% ISO (achieved with more OBA), or a HYP substitution rate of higher than 15%, slightly more OBA than the control (0% OBA-treated HYP) is needed to reach the same brightness and whiteness.

In general, OBA-treated HYP can be used to replace part of BKP in printing and writing paper with negligible effect on the brightness, whiteness and yellowness of paper products even when OBA is used as well at the wet-end of the papermaking process. Under normal conditions, the efficiency of OBA added at the paper machine remains similar whether there is OBA already on HYP fibers or not.

Advantages of Adding OBA to HYP During the HYP Manufacturing Process

The advantages of adding OBA to HYP during the HYP manufacturing process over the conventional wet-end OBA addition are discussed below.

Improving the OBA Efficiency

Figure 4:
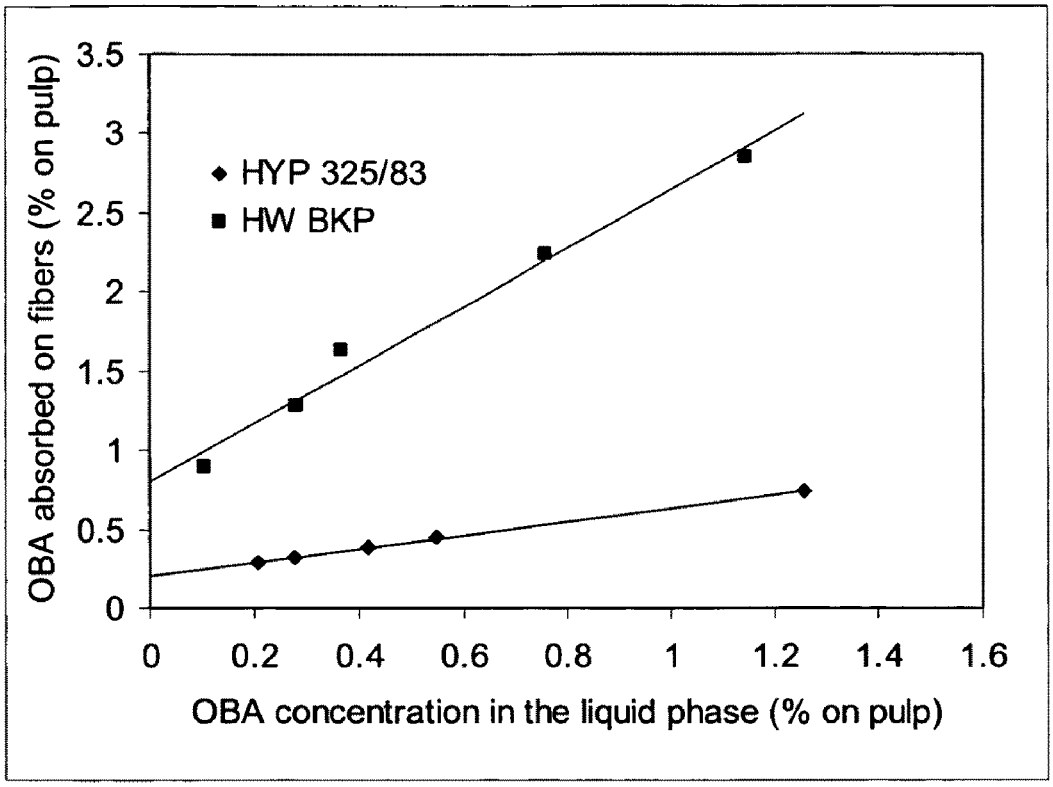
FIG. 4 shows a comparison of the adsorption of OBA on HYP and BKP (Tetra-sulfonic OBA, pH 6.5, 2-hour contact time, room temperature)

OBA molecules adsorb on pulp fibers by forming hydrogen bonding with cellulose fibers. When OBA is added to a furnish that contains both HYP and BKP, OBA will adsorb preferably on BKP fibers as they are essentially free of lignin. As shown in FIG. 4, at the same OBA concentration in the liquid phase, the BKP fibers adsorbed much more OBA than the HYP fibers. It would be beneficial to have more OBA adsorbed on HYP fibers. OBA may cover up and/neutralize the yellowish color of HYP fibers more effectively when it is on HYP fibers. As shown in Table 3, at the same OBA dosage, the whitening efficiency of OBA was slightly better when it was added to HYP at the pulp mill.

Minimizing the Interference from Cationic Polymers such as PEI

It is well known that cationic polymers and metal ions have negative effects on the performance of OBA [6, 15]. PEI is a cationic polymer that is commonly used in the retention systems to neutralize the negative effect of anionic trash. It can react with OBA to form complexes and reduce the brightening efficiency of OBA. A pre-adsorption of OBA onto pulp fibers before PEI addition may reduce their interaction, leading to an improved OBA efficiency.

Table 4 compares the efficiency of two OBA addition methods (A and B) at various HYP substitution rates and OBA dosages, in the presence of PEI (0.2%). Method A is a lab simulation of adding OBA to HYP at the pulp mill, and Method B is a lab simulation of the conventional wet-end addition of OBA. The results show that at the same HYP substitution rate and OBA dosage, Method A always gave higher brightness and whiteness, and lower yellowness (b*). The higher OBA efficiency of Method A is due to less quenching effect from PEI.

FIG. 4 compares the brightness gain from OBA (fluorescent composition) of the two systems at various conditions, which demonstrates the superior OBA performance when added during the HYP manufacturing process.

For Method B, OBA is usually added to the pulp fibers first and as far as possible from the addition point of PEI to decrease their interactions. However, the conclusion does not change even when the time interval between OBA and PEI additions was up to 60 minutes for Method B (Table 5). To minimize the interference of PEI more effectively, OBA would have to be absorbed and fixed on fibers. The drying process after OBA addition in the HYP manufacturing process may help fix OBA molecules on fibers by forming more and stronger hydrogen bonding.

Minimizing the Interference of Metal Ions in the White Water

Metal ions such as $Al^{3+}$ and $Fe^{3+}$ are present in the white water system, in particular for the acidic papermaking system. These metal ions can react with OBA molecules to form deposits and thus decrease the OBA efficiency [6]. Fixing OBA molecules onto fibers by adding OBA to HYP at the pulp mill can reduce their reactivity towards the harmful metal ions. In Table 6, various amount of $Al^{3+}$ and $Fe^{3+}$ ions were added to pulp suspension, and the tolerance of OBA to the metal ions was compared between the two addition methods, with all other conditions unchanged. The results show that the interference of metal ions is significantly less when OBA is added to HYP at the pulp mill (Method A), evidenced by the constantly higher brightness, fluorescence composition and whiteness, and lower yellowness.

Decreasing the Color Reversion

Figure 5:
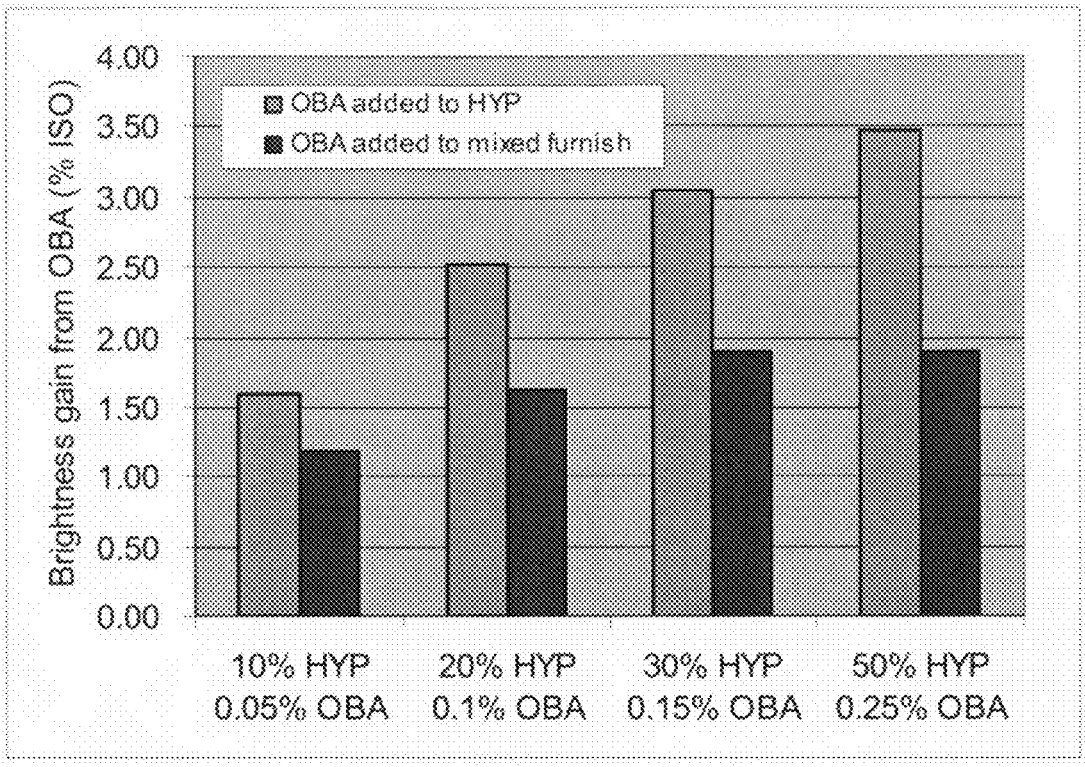
FIG. 5 shows a comparison of the brightening efficiency of OBA between two addition methods with the presence of PEI (30% SW BKP, 20-60% HW, 10-50% HYP (Aspen 325/85), 0.05-0.25% Di-sulfonic OBA, 0.2% PEI)

Another advantage of adding OBA to HYP at the pulp mill is that OBA on HYP fibers may also act as a UV screen and thus decrease the photo-yellowing (color reversion) of HYP during shipping, storage and application [16, 17]. As shown in FIG. 5, the photo-reversion of OBA-treated HYP is much less than the regular HYP when exposed to UV radiation under the same conditions.

Figure 6:
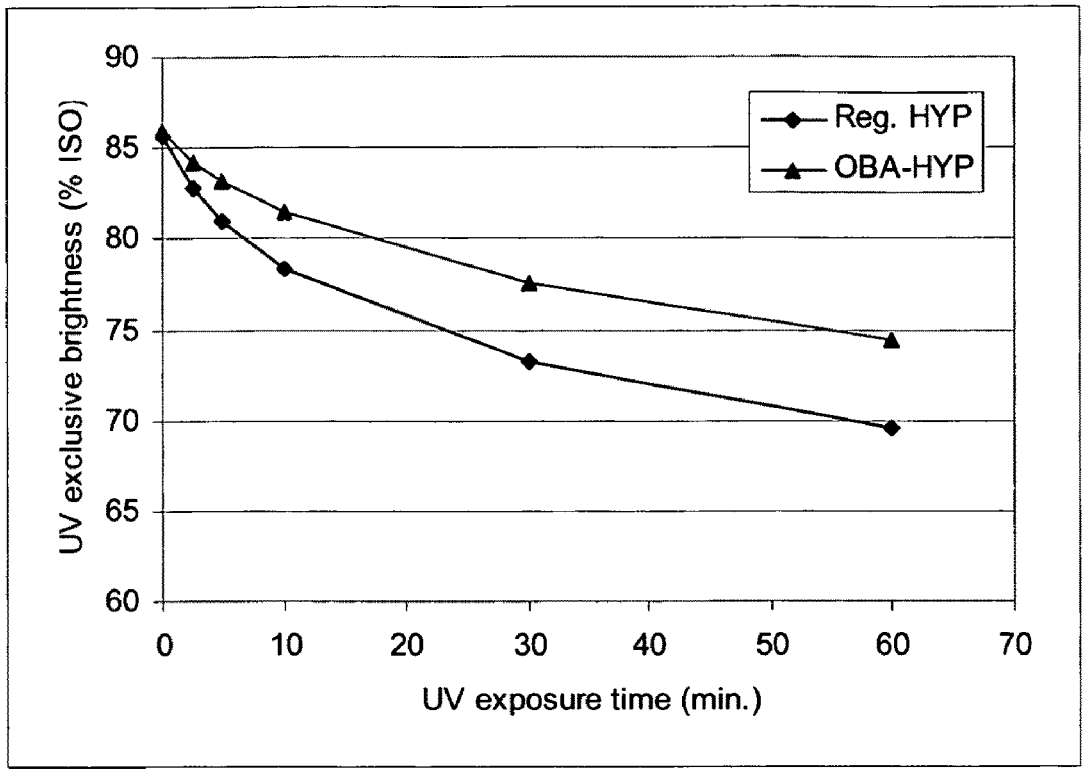
FIG. 6 shows the effect of OBA on the accelerated photo-reversion of HYP under intensive UV radiation (Photo reactor: 350 nm nominal wavelength, 2.7 $mW/cm^2$ intensity)
Figure 7:
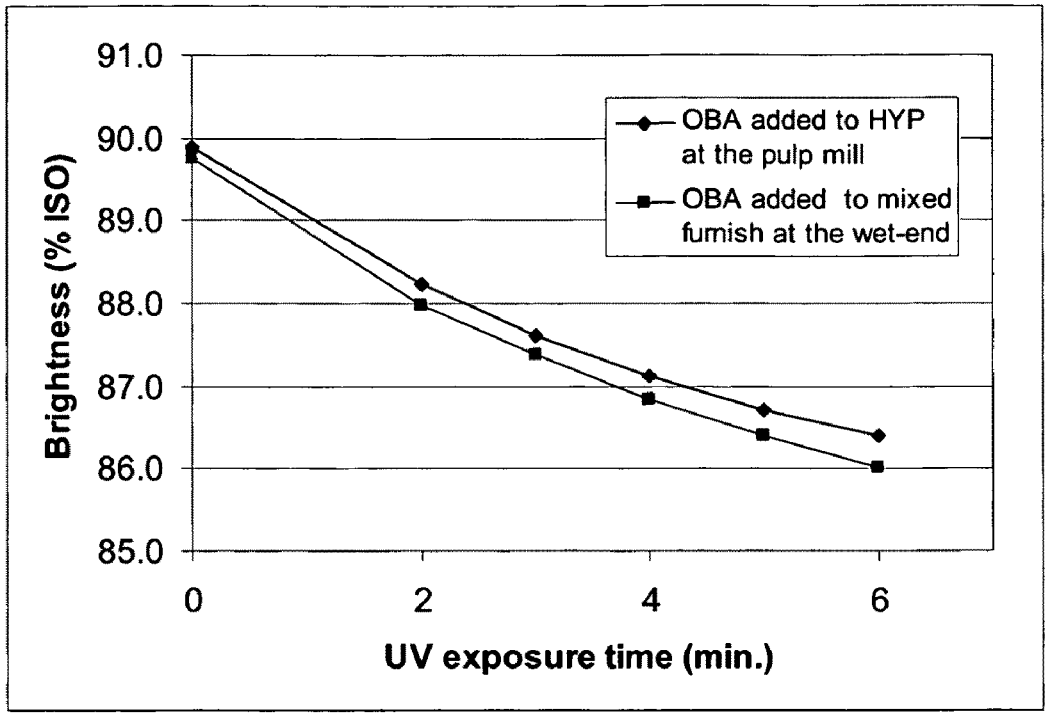
FIG. 7 shows brightness vs time of exposure to fluorescent light (top graph) and whiteness vs time of exposure to fluorescent light (bottom graph) showing a comparison of the UV reversion of HYP-containing paper sheets between the two OBA addition methods (50% HYP+50% HW BKP, 0.25% Tinopal UP; Photo reactor: 350 nm nominal wavelength, 2.7 $mW/cm^2$ intensity)
Figure 7:
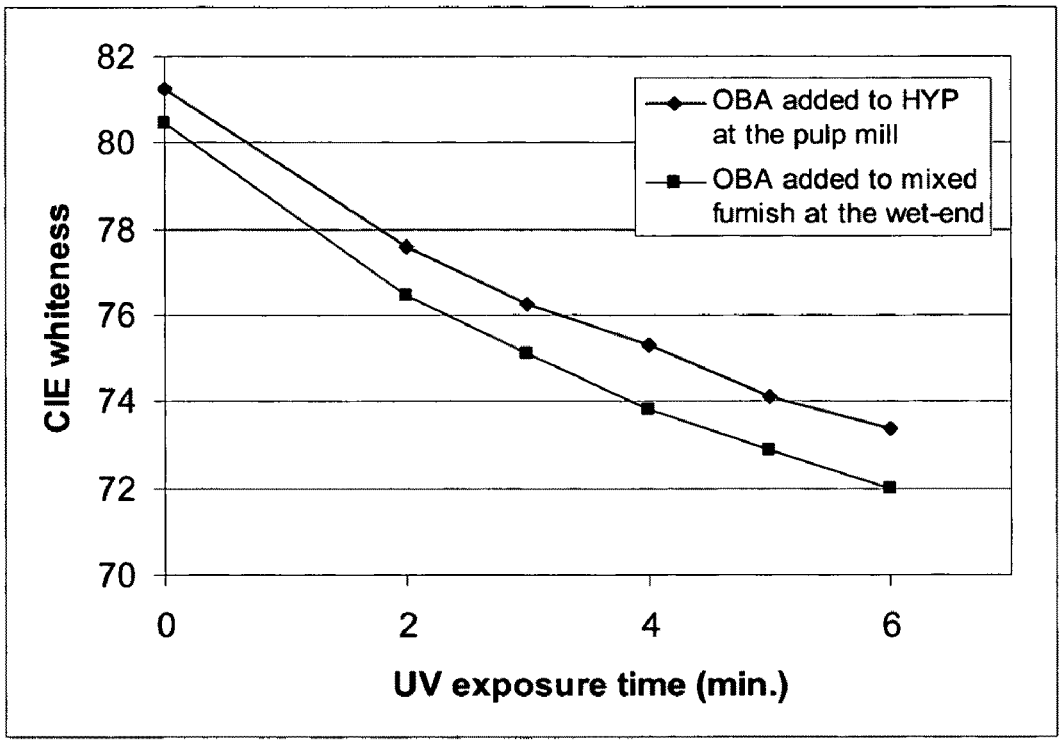
Figure 8:
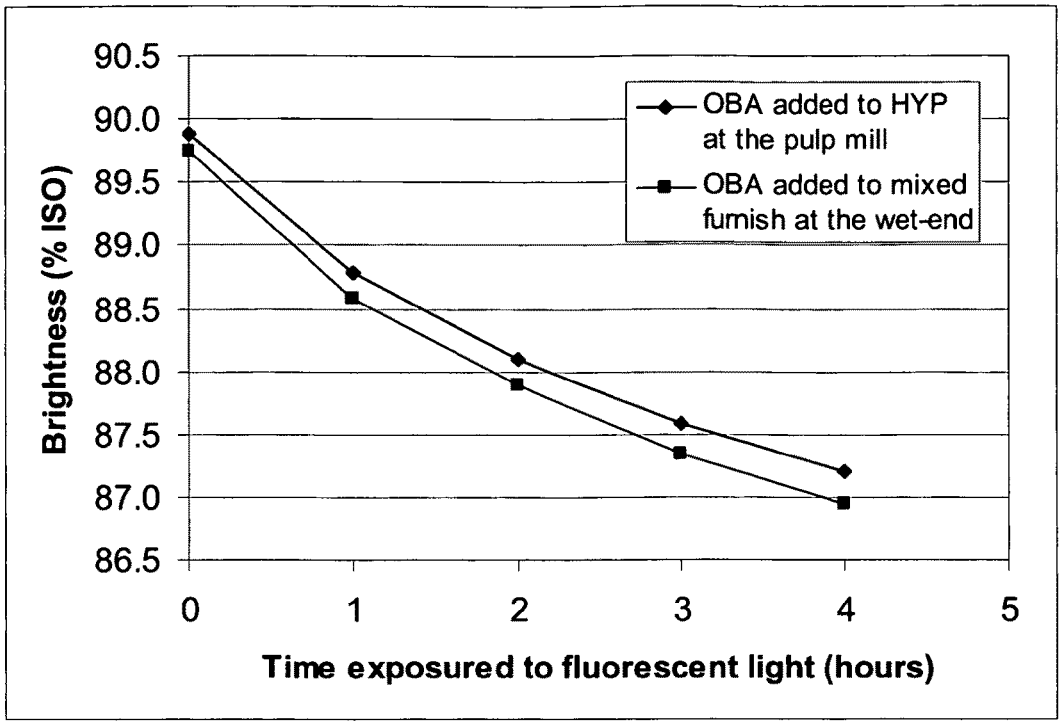
FIG. 8 shows brightness vs time of exposure to fluorescent light (top graph) and whiteness vs time of exposure to fluorescent light (bottom graph) showing a comparison of the fluorescent light reversion of HYP-containing sheets between two OBA addition methods (50% HYP+50% HW BKP, 0.25% Tinopal UP; Photoreactor: 9-10 $mW/cm^2$ intensity, about 53 times greater than the intensity of normal office light).
Figure 8:
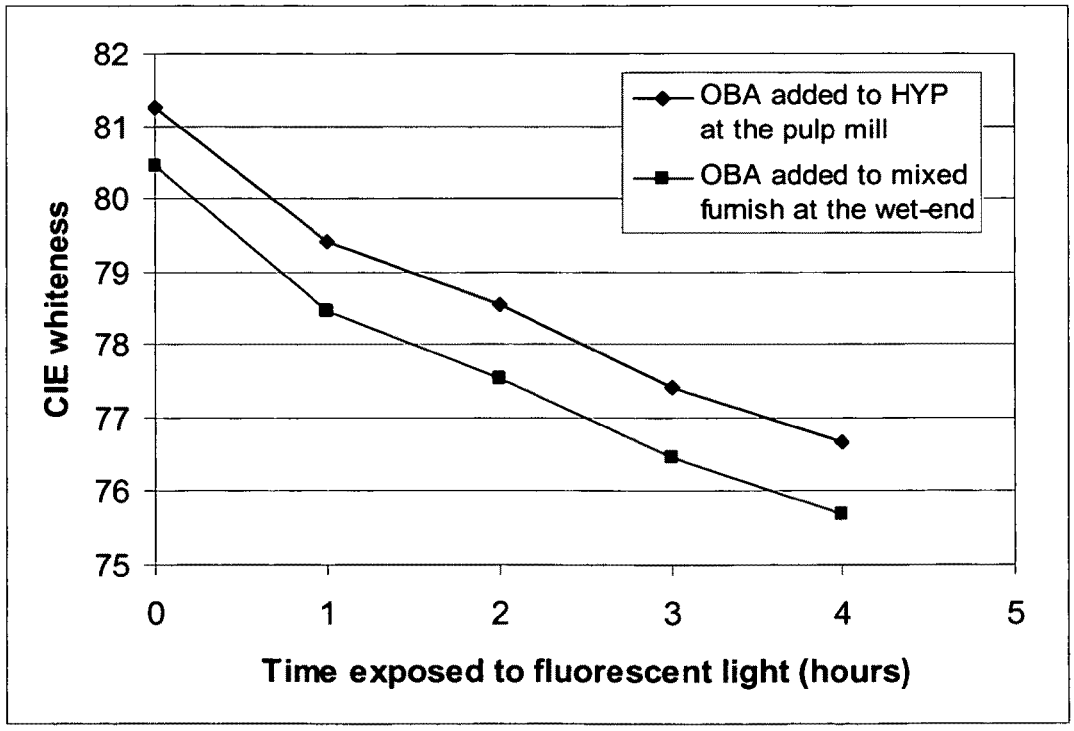

The same benefit can also be seen when using the OBA-treated HYP in the production of HYP-containing paper. If OBA is added to HYP at the pulp mill, more OBA will stay on HYP fibers to protect them from light radiation and thus decrease the photo-reversion of the paper. As shown in FIGS. 6 and 7, a noticeable reduction in reversion was observed for the paper sheet with OBA-treated HYP in both the UV and fluorescent light treatments.

Other Practical Considerations

In some paper mills, HYP is co-refined with hardwood BKP. A question arises as to whether the strong mechanical force and interaction between HYP and BKP fibers during co-refining will diminish the benefits of OBA-treated HYP. To answer this question, the inventors designed another set of experiments as shown in Table 7. For Method A, 50% OBA-treated HYP was co-refined with 50% HW BKP in a PFI mill to 450 ml CSF, and was then made into handsheets under different wet-end conditions; for Method B, 50% regular HYP was co-refined with 50% HW BKP, and then OBA was added. The results in Table 7 show that Method A is still much better than Method B with respect to the brightening efficiency of OBA. Therefore, one can conclude that the benefits of the OBA-treated HYP can be maintained after the co-refining process.

Another question is the affinity of OBA on HYP fibers, once added in the HYP manufacturing process. Water extraction at 50° C. is a good simulation of the situation in a paper mill where the OBA-treated HYP will be used in the process. As shown in Table 8, a hot water extraction (50° C., 1 hour) changed the optical properties of the OBA-treated HYP only slightly.

To test the affinity of OBA on HYP fibers under a high shear force environment, a standard disintegrator operated at 3000 rpm was used to simulate the re-pulping, refining and pumping processes in a paper mill. As shown in Table 9, the change of the optical properties of the OBA-treated HYP was small, indicating that the OBA-treated HYP can survive the typical mechanical treatments in a paper mill.

OBA can be a cost-effective solution to improve the optical properties of HYP. A partial substitution of HW BKP with the OBA-treated HYP has negligible influence on the final paper brightness and whiteness, which would be an encouragement to more HYP applications in more paper grades. Neither OBA has interference to the alkaline peroxide bleaching process, nor the bleaching chemicals on the performance of OBA. Therefore, the OBA brightening process can be incorporated into the peroxide bleaching process conveniently.

Adding OBA to HYP at the pulp mill can have several advantages over the conventional wet-end addition of OBA. First, the quenching effect on OBA by the wet-end cationic polymers such as PEI can be decreased by fixing OBA on HYP fibers before going into the papermaking process. Moreover, the negative impact of metal ions in the white water system on the OBA performance can be minimized when OBA is pre-adsorbed and fixed on HYP fibers. Furthermore, the photo-yellowing (color reversion) of HYP and HYP-containing paper sheets can be decreased when more OBA is on HYP fibers to protect them from harmful UV radiation. OBA has good affinity to HYP fibers when it is added in the HYP manufacturing process, and it retains well when subjected to water extraction (50° C.), disintegration and co-refining treatments.

TABLE 3

COMPARISON OF THE OBA EFFICIENCY BETWEEN TWO ADDITION METHODS

| Addition Method | A: OBA added to HYP at the pulp mill | | B: OBA added to mixed furnish at the wet-end | |
|---|---|---|---|---|
| OBA dosage (%, on total furnish) | 0.25 | 0.50 | 0.25 | 0.50 |
| Brightness, % ISO | 90.7 | 91.9 | 90.3 | 91.5 |
| CIE Whiteness | 84.1 | 87.2 | 83.0 | 86.5 |
| b* | 1.97 | 1.30 | 2.21 | 1.38 |

Note:
Furnish composition: 30% SW + 20% HW + 50% HYP;
OBA: Di-sulfonic OBA;
wet-end conditions: 1% pulp consistency; pH 6.5, 100 ppm $Ca^{2+}$, 5 minutes of contact time.

TABLE 4

COMPARISON OF THE EFFECT OF PEI ON OBA EFFICIENCY BETWEEN THE TWO OBA ADDITION SYSTEMS

| PEI dosage, % | HYP % | OBA dosage % | Brightness % ISO | b* | CIE whiteness |
|---|---|---|---|---|---|
| A: OBA was added to HYP at the pulp mill | | | | | |
| 0.2 | 10 | 0.05 | 87.54 | 3.38 | 76.44 |
| 0.2 | 20 | 0.10 | 88.78 | 2.72 | 79.66 |
| 0.2 | 30 | 0.15 | 88.72 | 2.46 | 80.31 |
| 0.2 | 50 | 0.25 | 89.27 | 2.67 | 80.16 |
| 0 | 30 | 0.15 | 90.68 | 2.05 | 83.70 |
| B: OBA was added to mixed furnish at the wet-end | | | | | |
| 0.2 | 10 | 0.05 | 86.22 | 3.62 | 74.35 |
| 0.2 | 20 | 0.10 | 87.05 | 3.38 | 75.84 |
| 0.2 | 30 | 0.15 | 87.49 | 3.42 | 76.12 |
| 0.2 | 50 | 0.25 | 87.30 | 3.82 | 74.51 |

Furnish: 30% SW BKP, 20-60% HW BKP and 10-50% HYP (Aspen 325/85); OBA type: Di-sulfonic; 0.2% PEI; OBA was added first, followed by the addition of PEI after 2 minutes of mixing, and a handsheet was made after another 5 minutes of mixing.

TABLE 5

EFFECT OF TIME INTERVAL BETWEEN OBA AND PEI ADDITION ON OBA EFFICIENCY

| OBA addition method | Time interval between OBA and PEI addition, (min.) | Brightness (% ISO) | Bright. gain due to OBA (% ISO) | b* | CIE whiteness |
|---|---|---|---|---|---|
| Method B | 2 | 87.51 | 1.89 | 3.42 | 76.12 |
| Method B | 20 | 87.79 | 2.04 | 3.28 | 76.83 |
| Method B | 60 | 87.68 | 2.01 | 3.18 | 77.11 |
| Method A | — | 88.72 | 2.75 | 2.46 | 80.31 |

Other conditions: 30% SW BKP + 40% HW BKP + 30% HYP, 0.15% OBA (Di-sulfonic); OBA was added to the mixed furnish before the addition of PEI (0.2%).

TABLE 6

EFFECT OF METAL IONS ON OBA EFFICIENCY

| Wet-end conditions | Brightness (% ISO) | Bright. gain due to OBA (% ISO) | b* | CIE Whiteness |
|---|---|---|---|---|
| A: OBA was added to HYP at the pulp mill (0.15% Di-sulfonic OBA) | | | | |
| Blank A | 90.4 | 3.6 | 2.5 | 82.0 |
| $Al^{3+}$ 2.5 ppm | 90.3 | 3.6 | 2.5 | 81.7 |
| $Al^{3+}$ 5.0 ppm | 90.2 | 3.6 | 2.6 | 81.3 |
| $Al^{3+}$ 10 ppm | 89.6 | 3.5 | 2.8 | 80.2 |
| $Al^{3+}$ 20 ppm | 89.4 | 3.4 | 2.9 | 79.6 |
| $Fe^{3+}$ 0.1 ppm | 90.1 | 3.6 | 2.6 | 81.4 |
| $Fe^{3+}$ 0.2 ppm | 90.0 | 3.5 | 2.5 | 81.3 |
| $Fe^{3+}$ 0.4 ppm | 89.0 | 3.4 | 2.5 | 80.5 |
| $Fe^{3+}$ 0.8 ppm | 88.2 | 3.3 | 2.6 | 79.3 |
| B: OBA was added to the mixed furnish at the wet-end (0.15% di-sulfonic OBA) | | | | |
| Blank B | 90.5 | 3.6 | 2.5 | 81.9 |
| $Al^{3+}$ 2.5 ppm | 88.3 | 2.7 | 3.4 | 77.1 |
| $Al^{3+}$ 5.0 ppm | 88.2 | 2.3 | 3.5 | 76.5 |
| $Al^{3+}$ 10 ppm | 88.1 | 1.9 | 3.5 | 76.7 |
| $Al^{3+}$ 20 ppm | 88.0 | 1.7 | 3.8 | 75.7 |
| $Fe^{3+}$ 0.1 ppm | 87.8 | 1.4 | 3.8 | 75.3 |
| $Fe^{3+}$ 0.2 ppm | 87.6 | 1.4 | 3.9 | 74.9 |
| $Fe^{3+}$ 0.4 ppm | 87.3 | 1.5 | 3.7 | 75.0 |
| $Fe^{3+}$ 0.8 ppm | 86.4 | 1.5 | 3.7 | 74.1 |

Other conditions: 30% SW BKP + 30% HYP + 40% HW BKP; pH 4.5; 5 minutes.

TABLE 7

COMPARISON OF THE TWO OBA ADDITION METHODS WITH CO-REFINING OF HYP AND BKP

| Wet-end conditions | Brightness (% ISO) | Bright. gain due to OBA (% ISO) | b* | CIE Whiteness |
|---|---|---|---|---|
| A: OBA was added to HYP at the pulp mill (0.25% Di-sulfonic OBA) | | | | |
| Blank A, pH 6.5 | 89.6 | 4.81 | 2.83 | 80.0 |
| 0.2% PEI, PH = 6.5 | 89.2 | 4.06 | 2.73 | 79.7 |
| 0.5% PEI, PH = 6.5 | 87.2 | 3.95 | 3.65 | 74.9 |
| 20 ppm $Al^{3+}$, pH 4.5 | 88.2 | 4.21 | 3.41 | 76.6 |
| 20 ppm $Al^{3+}$, PH = 6.5 | 90.1 | 4.86 | 2.45 | 81.6 |
| 1.0 ppm $Fe^{3+}$, PH = 4.5 | 84.7 | 4.11 | 2.79 | 74.7 |
| 1.0 ppm $Fe^{3+}$, PH = 6.5 | 85.0 | 4.26 | 2.53 | 76.0 |
| B: OBA was added to mixed furnish at the wet-end (0.25% Di-sulfonic OBA) | | | | |
| Blank B, pH 6.5 | 89.7 | 3.96 | 3.18 | 79.1 |
| 0.2% PEI, PH = 6.5* | 86.3 | 1.67 | 4.23 | 72.0 |
| 0.5% PEI, PH = 6.5* | 85.2 | 2.12 | 4.87 | 68.8 |
| 0.5% PEI, pH = 6.5** | 85.4 | 2.72 | 4.60 | 70.0 |
| 20 ppm $Al^{3+}$, pH 4.5 | 85.7 | 2.14 | 4.69 | 70.2 |
| 20 ppm $Al^{3+}$, PH = 6.5 | 89.4 | 4.53 | 2.55 | 80.7 |
| 1.0 ppm $Fe^{3+}$, PH = 4.5 | 83.1 | 2.45 | 3.80 | 69.9 |
| 1.0 ppm $Fe^{3+}$, PH = 6.5 | 84.9 | 3.85 | 2.64 | 75.6 |

Furnish: 50% HYP + 50% HW BKP; OBA treated HYP was air-dried to simulate the commercial HYP process.
Co-refining of HYP and HW BKP: 2000 PFI revolution to about 450 ml CSF.
*PEI was added before OBA;
**OBA was added before PEI.

TABLE 8

EFFECT OF HOT WATER EXTRACTION ON THE OPTICAL PROPERTIES OF OBA-TREATED HYP

| OBA dosage (%) | Brightness (% ISO) | L* | a* | b* | CIE Whiteness | Fluorescent Comp. (% ISO) |
|---|---|---|---|---|---|---|
| Before hot water extraction | | | | | | |
| 0 | 83.3 | 96.9 | −1.37 | 6.93 | 60.6 | 0 |
| 0.05 | 84.2 | 96.8 | −1.11 | 6.19 | 63.9 | 0.89 |
| 0.2 | 85.8 | 96.9 | −0.68 | 5.04 | 69.2 | 2.57 |
| 0.6 | 87.7 | 96.9 | −0.22 | 3.89 | 74.6 | 4.39 |
| After hot water extraction (1.0% consistency, 50° C. for 1 hour) | | | | | | |
| 0 | 83.1 | 96.6 | −1.25 | 6.65 | 60.2 | 0 |
| 0.05 | 84.0 | 96.6 | −1.10 | 5.89 | 63.6 | 0.82 |
| 0.2 | 85.4 | 96.7 | −0.66 | 5.03 | 68.8 | 2.15 |
| 0.6 | 86.9 | 96.6 | −0.24 | 3.89 | 73.9 | 3.75 |

Note:
HYP grade: Aspen 325/83; OBA type: Di-sulfonic.

TABLE 9

EFFECT OF MECHANICAL TREATMENT ON OBA-TREATED HYP

| OBA dosage (%) | Brightness (% ISO) | L* | a* | b* | CIE whiteness | Fluorescent Comp. (% ISO) |
|---|---|---|---|---|---|---|
| Before re-pulping | | | | | | |
| 0 | 83.7 | 97.1 | −1.51 | 7.00 | 60.8 | 0 |
| 0.2 | 85.6 | 96.9 | −0.78 | 5.23 | 68.3 | 2.57 |
| 0.6 | 87.6 | 97.0 | −0.37 | 4.08 | 73.9 | 4.39 |
| After re-pulping (disintegration at 3,000 rpm for 5 minutes, 0.5% consistency) | | | | | | |
| 0 | 83.2 | 96.8 | −1.24 | 6.82 | 60.8 | 0 |
| 0.2 | 85.4 | 96.8 | −0.70 | 5.22 | 68.2 | 2.23 |
| 0.6 | 87.1 | 96.8 | −0.36 | 4.13 | 73.3 | 3.98 |

TABLE 9-continued

EFFECT OF MECHANICAL TREATMENT ON OBA-TREATED HYP

| OBA dosage (%) | Brightness (% ISO) | L* | a* | b* | CIE whiteness | Fluorescent Comp. (% ISO) |
|---|---|---|---|---|---|---|

Note:
HYP grade: Aspen 325/83; OBA type: Di-sulfonic.

Thus, broadly speaking, the present invention provides a process for bleaching wood pulp, comprising the steps of mixing a wood pulp slurry containing a chelating agent to form a mixture which is washed and pressed to yield a transition metal-depleted pulp slurry and a discharge effluent. This transition metal-depleted pulp slurry is mixed with an alkaline peroxide bleaching liquor including at least $H_2O_2$ and an optical brightening agent (OBA) to form a mixture which is bleached to give a peroxide bleached pulp containing the optical brightening agent.

As used herein, the terms "comprises", "comprising", "including" and "includes" are to be construed as being inclusive and open ended, and not exclusive. Specifically, when used in this specification including claims, the terms "comprises", "comprising", "including" and "includes" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

References

1. Zhou, Y., "Overview of high yield pulps (HYP) in paper and board", PAPTAC 90th Annual Meeting, 2004, B143-148 (Montreal, Canada)
2. Cannell, E. and Cockram, R., "The future of BCTMP", Pulp and Paper, 74(5): 61-76 (2000)
3. Reis, R., "The increased use of hardwood high yield pulps for functional advantages in papermaking", Proceedings of the 2001 Papermakers Conference, 2001, 87-108 (Cincinnati, Ohio, US)
4. Levlin, J. E., "On the use of chemi-mechanical pulps in fine papers", Paperi ja Puu—Paper and Timber, 72(4): 301-308 (1990)
5. Ford, M. and Sharman, P., "Performance of high yield hardwood pulp is investigated as it should be the choice of the future", Pulp & Paper International, 38(10): 29 (1996)
6. Neimo, L. (book editor), Papermaking Science and Technology, Book 4, Papermaking Chemistry, Fapet Oy, Helsinki, Finland (1999)
7. Ragauskas, A. J., Allison, L., Lucia, L. A. and Li, C., "Brightness reversion of mechanical pulps XIV: Application of FWAs for high-brightness, high-yield pulps", 2001 TAPPI PEER-REVIEWED PAPER/Solutions, 84(11): 55
8. Bourgoing, S, and Robert, S., "Inhibition of light induced colour reversion by diaminostilbene derivatives fluorescent whitening agents-molecular simulation correlation", Proceedings of PAPTAC 87th Annual Meeting, 2001, B47-B54
9. Scheringer, M., Halder, D. and Hungerbuhler, K, "Comparing the environmental performance of fluorescent whitening agents with peroxide bleaching of mechanical pulp", Journal of Industrial Ecology, 3(4): 77-95 (1999)

10. Zhang, H., He, Z., Ni, Y., Hu, H. and Zhou, Y., "Effectiveness of optical brightening agent (OBA) on high yield pulps (HYP)", Proceedings of 93rd PAPTAC Annual Meeting, February 2007, B235-240 (Montreal).
11. Zhang, H., Hu, H., Z. He, Y. Ni, and Y. Zhou, Retention of Optical Brightening Agents (OBA) and their brightening Efficiency on HYP-containing Paper Sheets, J. Wood Chem. Tech., 27(4): 115, 2007.
12. "Forming handsheets for reflectance testing of pulp (sheet machine procedure)", TAPPI Test Methods T272 (1992).
13. "Diffuse brightness of pulp (d/0°)", TAPPI test Methods, T525 (1992).
14. Zhang, H., He, Z., Ni, Y., Hu, H. and Zhou, Y., "Using optical brightening agents (OBA) for improving the optical properties of HYP-containing paper sheets", Proceedings of 94rd PAPTAC Annual Meeting, Feb. 5-7, 2008, B561-B569, (Montreal).
15. Crouse B. W. and Snow G. H., "Fluorescent whitening agent in the paper industry: Their chemistry and measurement", Tappi J., 64(7): 87-89 (1981).
16. Bourgoing, S., Leclerc, É., Martin, P. and Robert, S., "Use of fluorescent whitening agents to inhibit light-induced colour reversion of unbleached mechanical pulps", Journal of Pulp and Paper Science, 27(7): 240-244 (2001).
17. Bourgoing, S. and Robert, S., "Use of fluorescent whitening agents against light-induced colour reversion of high yield pulps", Proceedings of 9th International Symposium on Wood and Pulping Chemistry (ISWPC), Montreal, Canada, 10-1-10-4 (1997).

Therefore what is claimed is:

1. A process for bleaching wood pulp, comprising the steps of:

a) mixing a wood pulp slurry containing a chelating agent to form a mixture, and washing and pressing said mixture to produce a transition metal-depleted pulp slurry and a first discharge effluent; and b) bleaching the transition metal-depleted pulp slurry, by mixing, in a single step, the transition metal-depleted pulp slurry with an optical brightening agent (OBA) and an alkaline peroxide bleaching liquor to form a bleached pulp prior to a wet-end of a papermaking process.

2. The process according to claim 1 wherein the alkaline peroxide bleaching liquor comprises $H_2O_2$.

3. The process according to claim 1 wherein said transition metal-depleted pulp slurry of step (a) has an ISO of no more than about 56%.

4. The process according to claim 3 wherein the alkaline peroxide bleaching liquor comprises $H_2O_2$.

5. The process according to claim 2 wherein step b) includes adding an alkali source selected from the group consisting of NaOH, $Mg(OH)_2$, MgO, $MgSiO_3$, $Na_2CO_3$, and combinations thereof.

6. The process according to claim 2 wherein step b) includes adding a peroxide stabilizer selected from the group consisting of silicate, $MgSO_4$, DTPA, EDTA and combinations thereof.

7. The process according to claim 2 wherein the wood pulp is selected from the group consisting of mechanical pulps and high yield pulps.

8. The process according to claim 2 wherein the step of alkaline peroxide bleaching is carried out under high-consistency conditions.

9. The process according to claim 2 including repeating steps a) and b) a selected number of times.

10. The process according to claim 2 wherein said optical brightening agents are selected from the group consisting of di-sulfonic, tetra-sulfonic, hexa-sulfonic based optical brightening agents and other optical brightening agents.

11. The process according to claim 2 wherein said chelating agent is selected from the group consisting of diethylene tri-amine penta-acetic acid and its salts (DTPA), ethylene di-amine tetra-acetic acid and its salt (EDTA), and combinations thereof.

12. The process according to claim 2 wherein said transition metal-depleted pulp slurry of step (a) has an ISO of no more than about 56%.

13. The process according to claim 12 wherein step b) includes adding an alkali source selected from the group consisting of NaOH, $Mg(OH)_2$, MgO, $MgSiO_3$, $Na_2CO_3$, and combinations thereof.

14. The process according to claim 12 wherein step b) includes adding a peroxide stabilizer selected from the group consisting of silicate, $MgSO_4$, DTPA, EDTA and combinations thereof.

15. The process according to claim 12 wherein the step of alkaline peroxide bleaching is carried out under high-consistency conditions.

16. The process according to claim 12 including repeating steps a) and b) a selected number of times.

* * * * *